US010689224B1

(12) United States Patent
Bookland

(10) Patent No.: US 10,689,224 B1
(45) Date of Patent: Jun. 23, 2020

(54) ADJUSTABLE TURNTABLE FOR COILS AND SPOOLS

(71) Applicant: William Bookland, Lahaina, HI (US)

(72) Inventor: William Bookland, Lahaina, HI (US)

( * ) Notice: Subject to any disclaimer, the term of this patent is extended or adjusted under 35 U.S.C. 154(b) by 0 days.

(21) Appl. No.: 16/660,238

(22) Filed: Oct. 22, 2019

(51) Int. Cl.

| | |
|---|---|
| ***B65H 49/28*** | (2006.01) |
| ***B65H 49/30*** | (2006.01) |
| ***B65H 57/06*** | (2006.01) |
| ***B65H 49/32*** | (2006.01) |

(52) U.S. Cl.
CPC ..... *B65H 49/28* (2013.01); *B65H 49/30* (2013.01); *B65H 49/328* (2013.01); *B65H 57/06* (2013.01); *B65H 2402/351* (2013.01); *B65H 2701/33* (2013.01); *B65H 2701/34* (2013.01); *B65H 2701/35* (2013.01); *B65H 2701/36* (2013.01)

(58) Field of Classification Search
CPC .. B65H 49/30; B65H 49/328; B65H 2701/33; B65H 2701/34; B65H 2701/35; B65H 2701/36; B65H 2405/351; B65H 54/58
USPC ..... 242/577, 577.2, 577.4
See application file for complete search history.

(56) References Cited

U.S. PATENT DOCUMENTS

| | | | | | |
|---|---|---|---|---|---|
| 941,637 | A * | 11/1909 | Jameson | G01B 5/043 | 33/754 |
| 1,539,016 | A * | 5/1925 | Mizuno | B65H 49/30 | 242/577.2 |
| 2,300,869 | A * | 11/1942 | Brandes, Jr. | B21C 47/30 | 242/575.5 |
| 3,072,358 | A * | 1/1963 | Knapp | B65D 85/04 | 242/129 |
| 3,815,842 | A * | 6/1974 | Scrogin | B65H 49/305 | 242/423.1 |
| 8,672,253 | B2 * | 3/2014 | Rothell | B65H 49/305 | 242/401 |
| 9,908,738 | B1 * | 3/2018 | Toth | B65H 49/28 | |

* cited by examiner

*Primary Examiner* — William E Dondero
(74) *Attorney, Agent, or Firm* — Dale J. Ream

(57) ABSTRACT

A stackable apparatus for mounting and feeding coiled or spooled wire or cable includes a turnable that includes a turntable having a top surface that includes concentric measurement circles and that defines a pair of radial channels. The turntable includes a plurality of posts that are length adjustable and positioned in the pair of radial channels, respectively, and configured to guide a coil or receive the spool. Each post includes a post slide portion correspondingly shaped to slide in a respective radial channel. The apparatus includes a base having a pair of support members each having a longitudinal configuration fixedly attached to one another in a transverse arrangement so as to form conjoined members, the conjoined members defining a bore. A hub is received in the bore and operable to receive a post depending from the turntable for providing freewheeling rotation of the turntable.

20 Claims, 11 Drawing Sheets

ADJUSTABLE TURNTABLE FOR COILS AND SPOOLS

BACKGROUND OF THE INVENTION

Field of the Invention

The present invention relates generally to a coil/wire organizer and, more specifically, to a stackable apparatus for mounting and feeding rolls of wire or cable and wire on a spool from a turnable and spooling unspooled wire onto the turnable creating a coil of wire either dismountable for storage or spooling and feeding the coil of wire from the turnable.

Description of the Prior Art

Various wire organizers have been proposed for the payout of spooled and unspooled wire. While these organizers may be suitable for the purposes for which they where designed, they would not be as suitable for the purposes of the present invention as heretofore described.

Therefore, it would be desirable to provide a wire/cable organizer that serves as a turnable dispenser for rolls of wire or cable and wire wound on a spool and feeding spooled wire from the organizer through a wire/cable organizer aperture. Further, it would be desirable to provide a wire/cable organizer serving as an organizer for an indeterminate length of loose or uncoiled wire by mounting a free wire/cable end then rotating the turnable until the wire forms a coil of wire that can be dismounted for storage or the organizer can be used as a spool and feed for the coiled wire.

SUMMARY OF THE PRESENT INVENTION

Many consumable products used by individuals and industry come coiled, such as wire, rope, tubing, and conductors—single conductor cable, multiple conductors cable with or without metal cladding, such as fiber optic cable, coaxial cable and romex cable with packaging extending from a couple of straps holding the coil shape to product wound on a spool.

A primary object of the present invention is to provide an adjustable turntable for receiving coils of wire or cable and wire or cable on a spool and then paying out the wire. No limitation or distinction is made whether said coiled wire or spool is large, small, heavy, or light although different sizes and forms of the present invention may be better suitable in commerce relative to various respective sizes.

Another object of the present invention is to provide an adjustable turntable having a base comprising supports fastened to the distal ends of a pair of transverse longitudinal members with a receptacle in the members junction seating a hub with a cavity that supports the freewheeling turnable having a bottom side flange with a post mating with the hub.

Yet another object of the present invention is to provide a plurality of supports comprising structural uprights having a bottom end with a channel forming left and right leg segments with the upright's top end having an opposing shape, left and right channels with a middle leg, so that a plurality of the left and right legs with a slot therebetween and an opposing structural top end allows multiple adjustable turntables to be stacked with each turnable freely rotatable relative to the other turnables in the stack.

An additional object of the present invention is to provide frictional pads fixed to bottom of the left and right leg segments preferably manufactured of a frictional material to prevent movement during use and marring of a floor covering.

Still yet another object of the present invention is to further provide the structural uprights with pivotal flaps comprising spaced apart sidewall mounted flap supports housing bearings receiving top and bottom flap nubs allowing the flaps to pivot from a turntable disengaged position to an engaged position.

Still yet another object of the present invention is to provide flaps with a tensioning member, such as a spring, latched at one end to the flap and the other to the structural upright aiding in maintaining an outer boundary coil wall while product is moved onto and off of the turnable.

An additional object of the present invention is to provide fasteners and fastener apertures within the organizer uprights and fastener receptacles in the distal ends of the platform's longitudinal members creating the stationary portion of the organizer.

A further object of the present invention is to provide a turnable comprising a turntable having a plurality of concentric measurement circles and radial channels each seating a sliding post movable from a substantially center turntable position to a turntable peripheral position with each post having a quarter round shape in cross section allowing the posts to converge into a substantially round spindle configured to receive a spool aperture or selectively moved to a desired outward position for coiled wire.

Additional objects of the present invention will appear as the description proceeds.

The present invention overcomes the shortcomings of the prior art by providing a stackable adjustable turntable for mounting and feeding rolls of wire or cable and wire on a spool from the turnable and primarily being able to work equally well for either a coil or a spool.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment) with reference to FIGS. 1 to 11 of the accompanying drawings. This discussion should not be construed, however, as limiting the invention to those particular embodiments; practitioners skilled in the art will recognize numerous other embodiments as well. For definition of the complete scope of the invention, the reader is directed to appended claims.

Figure 1:
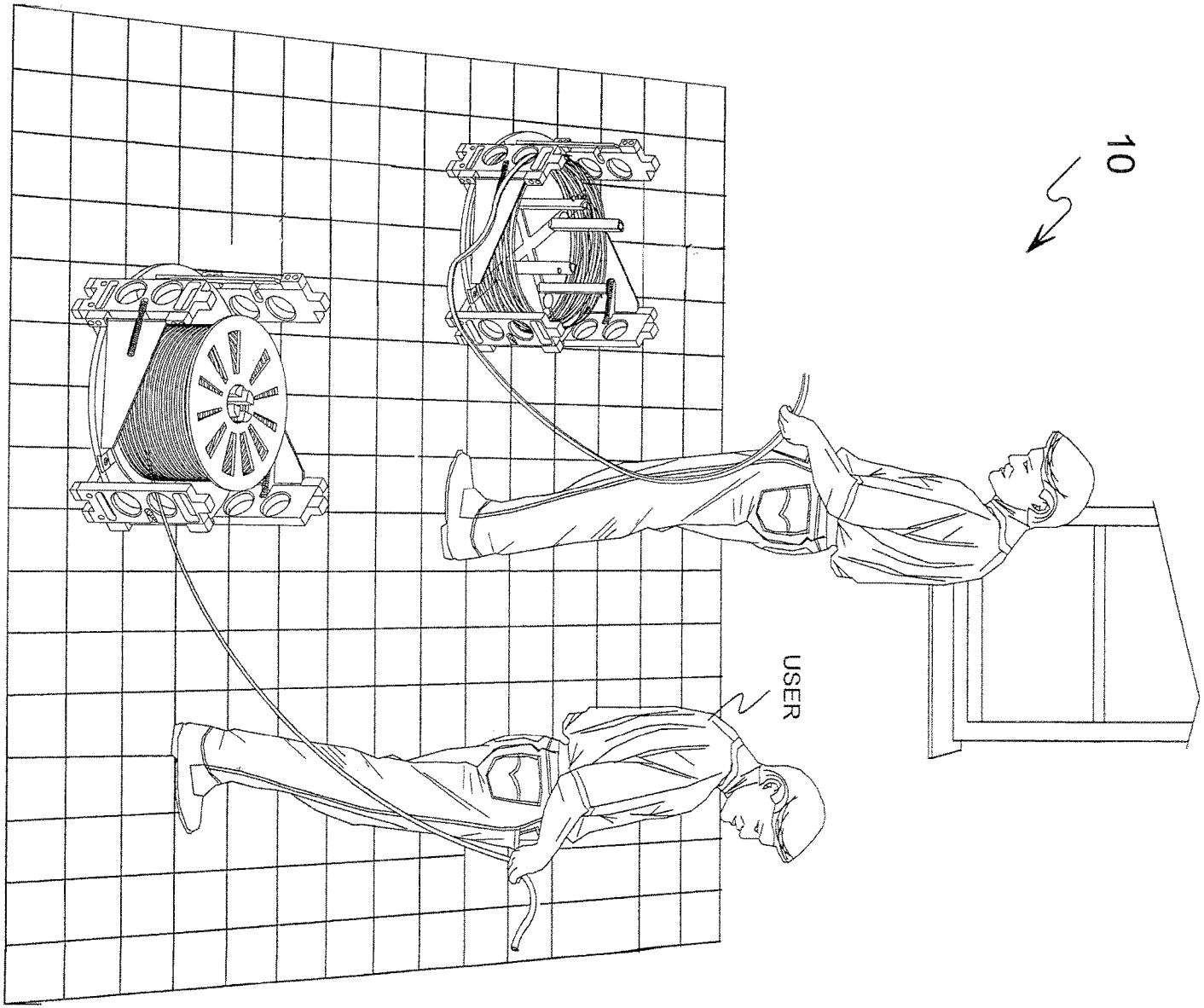
FIG. 1 is a perspective view of an adjustable turntable according to a preferred embodiment of the present invention, illustrated in use.

FIG. 1 is a perspective view of the present invention in use. Shown is the coil/spool organizer of the present invention designed to accept rolls of wire or cable and wire on a spool onto the organizer where then the wire/cable feeds out or into the organizer without bird nesting and by virtue of the frictional feet, such as rubber, prevents the organizer from sliding along a floor surface.

Figure 2:
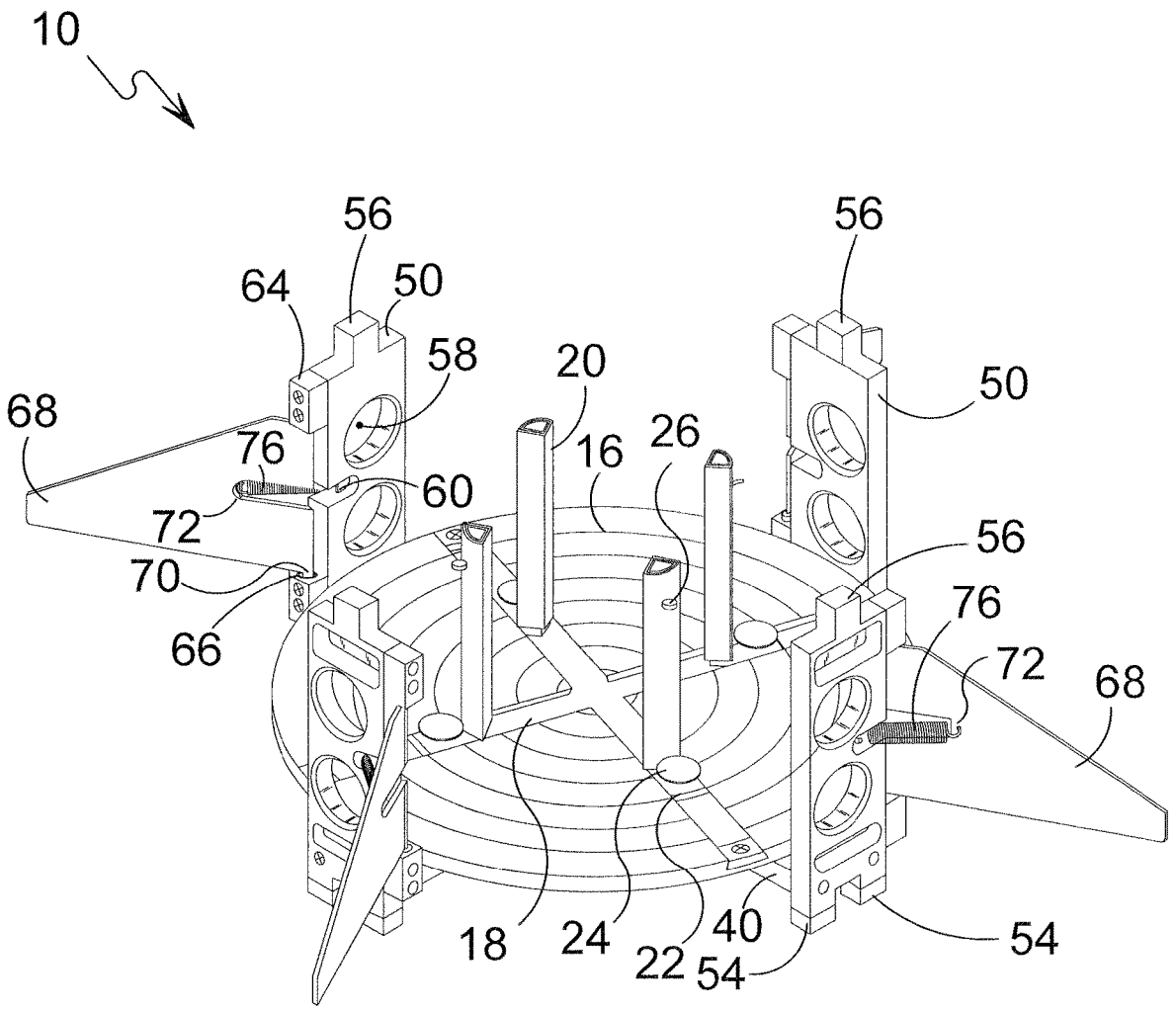
FIG. 2 is a perspective view of the adjustable turntable as in FIG. 1 according to a preferred embodiment of the present invention.

FIG. 2 is an assembled view of the present invention. The adjustable turntable for coils and spools 10 provides a turnable organizer 0 for wire/cable comprising a stationary frame 38 and a free wheeling turntable platform 14 with the frame 38 having circumferentially arrayed stanchions 50 defining apertures 58 serving as egress as the wire moves from the turntable platform 14 and ingress as wire is moved onto the turntable platform 14.

The adjustable turntable for coils of wire or cable and wire or cable on a spool 10 comprises turnable 12, hub 36 and base 38. Turnable 12 is a platform for mounting and feeding rolls of wire or cable and wire on a spool from turntable 14 and spooling unspooled wire onto turntable 14 having slidable, length-adjustable posts 20 movable to accommodate the smallest of spools and spaced apart for the larger diameter spools. For this application, stanchions 50 (which may also be referred to merely as uprights) create an outer boundary and are anchored for tensioned pivotal flaps 68 movable by operation of spring 76 between a turnable 12 disengaged position to a turntable 14 product engaged position since by virtue of the turnable 12 freewheeling nature tensioned flaps prevent bird nesting.

The turntable 14 has an upper surface having indicia and, more particularly, a plurality of concentric measurement circles 16 and the upper surface defined contoured radial channels 18 for from which the telescopic (i.e. length adjustable) posts 20 described above may extend. Further, each post 20 may include a base portion 22 correspondingly shaped to slide in a respective channel 18 with the base portion 22 further having a stop 22 to prevent unintended movement of a post 20 once positioned in a desired location.

Each post 20 has a telescopic configuration and functionality that is provided by inner and outer post portions defining apertures. The outer portion is raised to a desired height with an outer aperture positioned to align with an inner aperture with pin 26 inserted to latch the post to the desired height. Turntable 14 further includes a flange 28 fastened to the bottom side with a depending post 30 that, when seated into hub 38, provides freewheeling rotation of the turntable 14.

Base 38 forms the stationary portion of the adjustable turntable 10 and includes a pair of transverse longitudinal support members 40 fixedly attached through fasteners 44 with the conjoined support members 40 defining a bore 42 serving as seat for hub 36.

It should be noted that the physical size of the adjustable turntable for coils of wire or cable and wire or cable on a spool is a function of the lengths of the transverse longitudinal members 40 and height of uprights 50 (i.e. stanchions) and by upgrading components to hardened materials enables industrial use of larger wire/cable spools.

Stanchions (also referred to as uprights) 50, establishing an outer boundary size for coils and spools, are fastened to the distal ends of support members 40 with the uprights 50 and defined feed apertures 58 providing numerous openings that can serve as egress and ingress ports for wire moving from and to the turnable. When stacked coiled or spooled products can be moved from or to a stacked turntable from any of its peripheral stanchion feed apertures 58. In other words, having four uprights 50 enables dispensing product from four directions, as well as decreasing the overall weight of the device.

Uprights 50, by virtue of the frictional padded feet 54, serves as the stationary component enabling attachment of flap 68 components that can apply a peripheral force to the product on turntable 14 aiding in preventing casual movement of the product whether coil or spool and aids in maintaining an outer boundary for coils of wire/cable.

A plurality of flaps 68 are pivotally attached to a respective upright 50 through flap supports 64, each flap including bushings 66 seating flap nubs 70. The flap peripheral force is derived from attaching a tensioning member 76 to the stationary upright tension seat 60 of stationary upright 50 and to pivotal flap tension seat 72 of pivotal flap 68.

The adjustable turntable 10 is designed to be stacked by virtue of uprights 50 having complementary top and bottom ends. Upright 50 bottom end has a central channel forming left side and right side leg segments 52 provided with frictional pads 54 producing the device's frictional component to prevent slipping on a floor surface. Top end of upright 50 has an upstanding leg 56 correspondingly sized to the bottom end central channel with left and right notches correspondingly sized to receive the padded left and right bottom legs.

It should be noted that each base 38 in a stack of adjustable turntables is a stationary component with each of turnable 12 working independently from the other turnables in the stack. As aforementioned, the organizer of the present invention 10 is designed to accept rolls of wire or cable and wire on a spool onto the organizer where the wire feeds out of and/or into the organizer without bird nesting and by virtue of the frictional feet 54, such as rubber, prevents the adjustable turntable for coils of wire or cable and wire or cable on a spools 10 from sliding along a floor surface.

Figure 3:
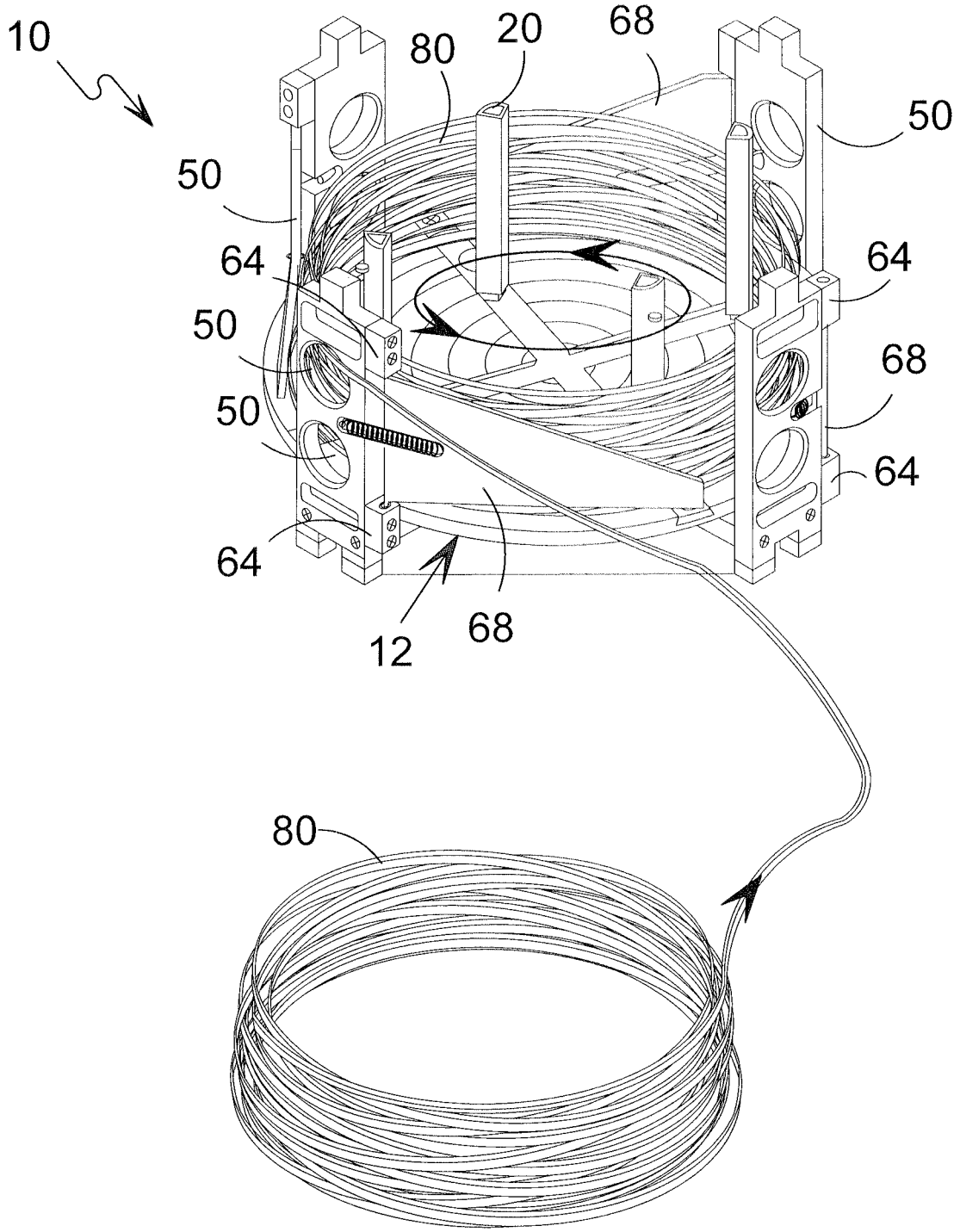
FIG. 3 is a perspective view of the adjustable turntable as in FIG. 1 illustrated in use to organize loose wire.

FIG. 3 is a perspective view of the turnable organizer used to organize loose wire. The organizer 10 serves the dual purpose of spooling loose wire onto the turnable platform. The turnable platform 12 provides radially arrayed posts 20 movable from a center position to a peripheral position as desired by the user. As illustrated, the loose wire 80 is contained between the plurality of frame stanchions 50 and plurality of turnable posts 20. The organizer frame further provides tensioned flaps 68 that maintain a loose wire peripheral tension in creating a roll of loose wire 80 or maintaining tension upon a mounted roll of loose wire 80 during use.

Figure 4:
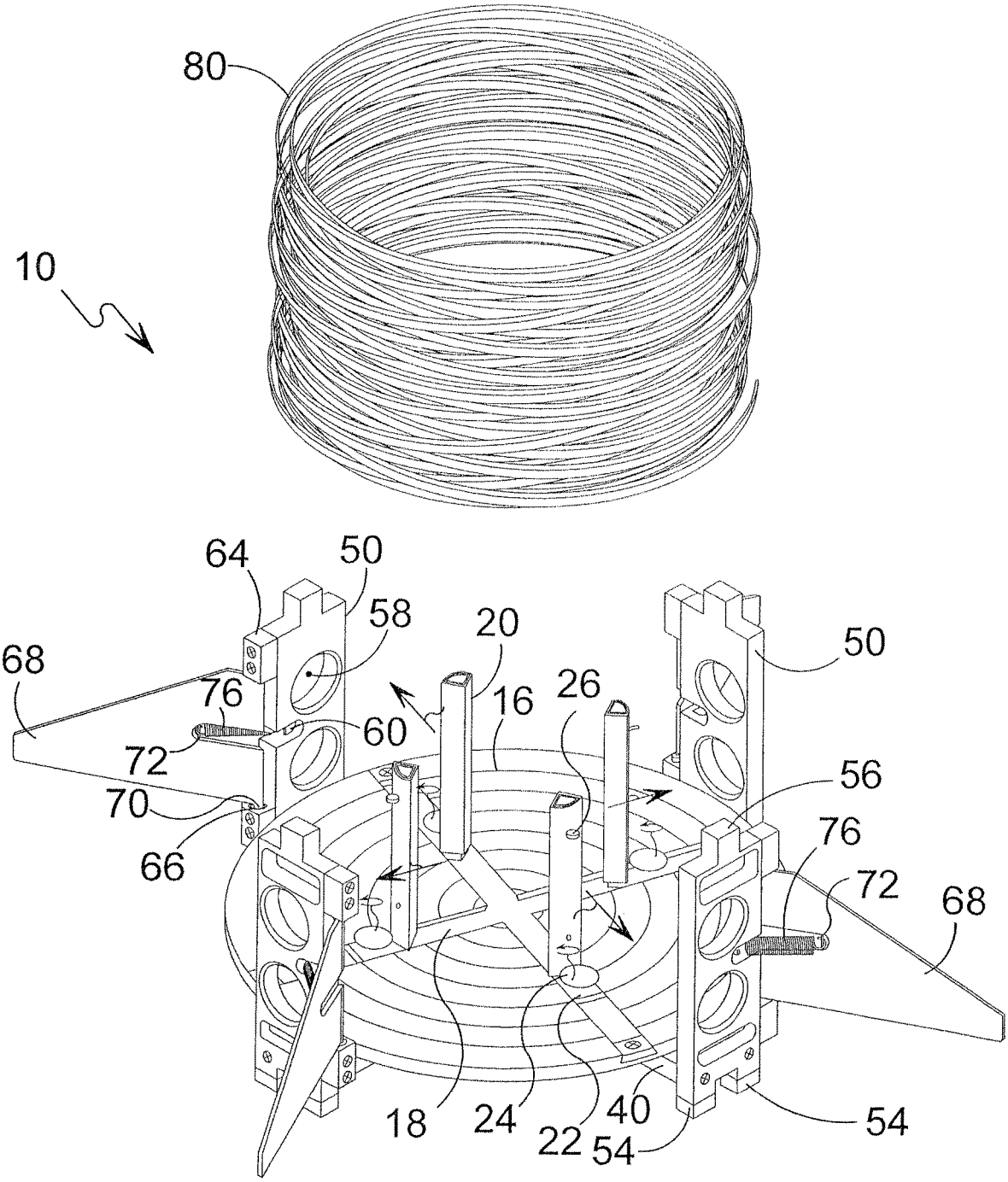
FIG. 4 is a perspective view of the adjustable turntable as in FIG. 2 setting up for use of rolled coiled wire.
Figure 5:
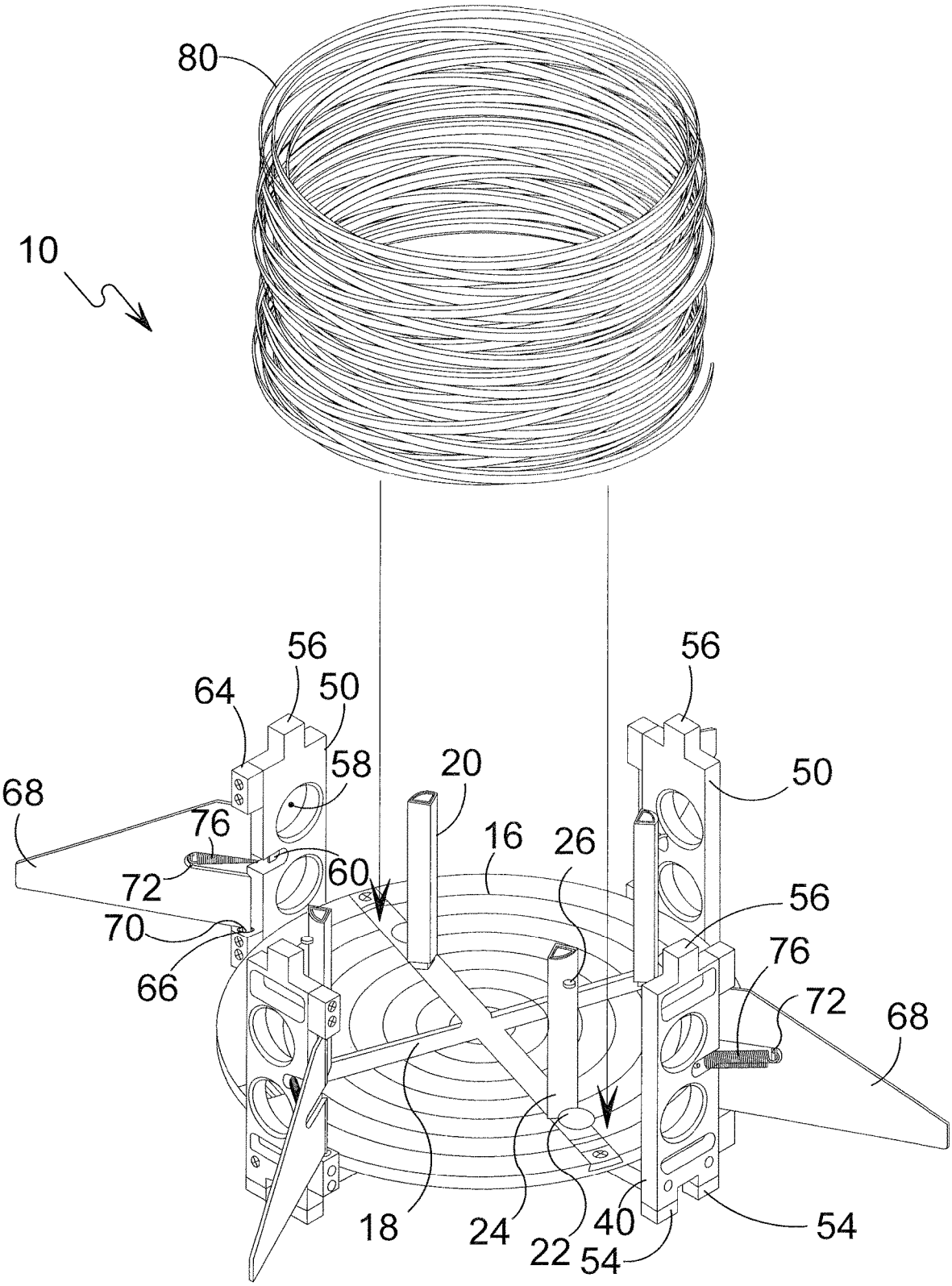
FIG. 5 is a perspective view of the adjustable turntable setting up for use of rolled coiled wire.
Figure 6:
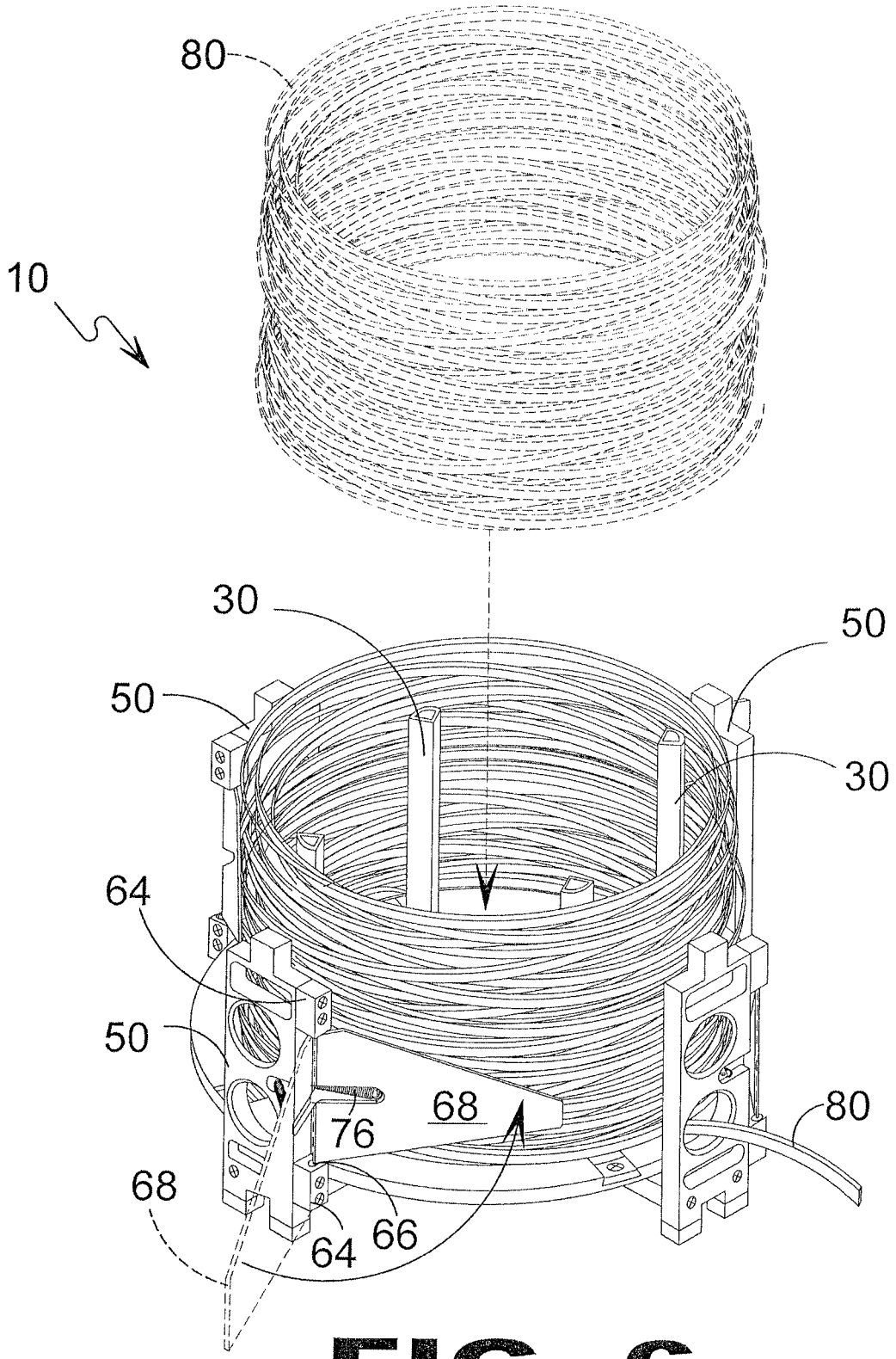
FIG. 6 is a perspective view of the adjustable turntable illustrate in receipt of coiled wire.

Referring to FIGS. 4, 5 and 6, a progression of steps is shown illustrating use of the organizer for rolled coiled wire. FIG. 4 and FIG. 5 illustrate views of organizer 10 setting up for use of rolled coiled wire 80. The turnable organizer 12 can be used either with coiled wire 82 or spooled wire 80, shown in later drawings, with the main difference being the position of the turntable 14 posts 20. For a roll of coiled wire 80 posts 20 are approximately positioned to the inner wall of the roll of coiled wire 80 with the frame's stanchions 50 and flaps 68 maintaining tension on the exterior wall of the roll of coiled wire 80. In FIG. 6, the roll of coiled wire 82 is positioned between the frame's stanchions 50, each stanchion defining a plurality of apertures 58 serving as wire ingress or egress as wire 80 moves off of and/or onto the roll of coiled wire 80 with the tensioning flap members 68 moved into engagement with the roll of coiled wire thereby substantially maintaining the structure of the roll of coiled wire.

Figure 7:
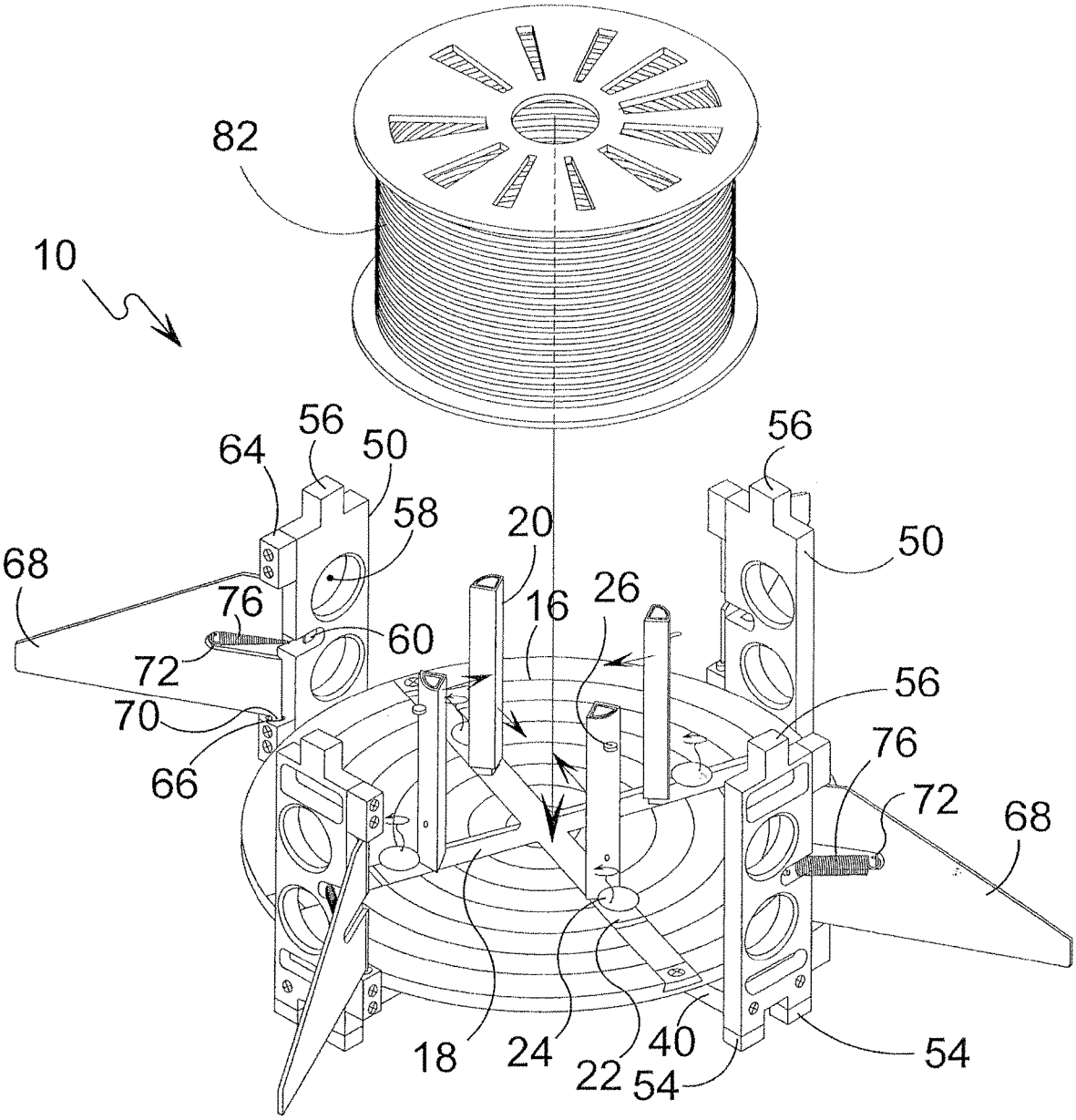
FIG. 7 is a perspective view of the adjustable turntable setting up for receipt of spooled wire.
Figure 8:
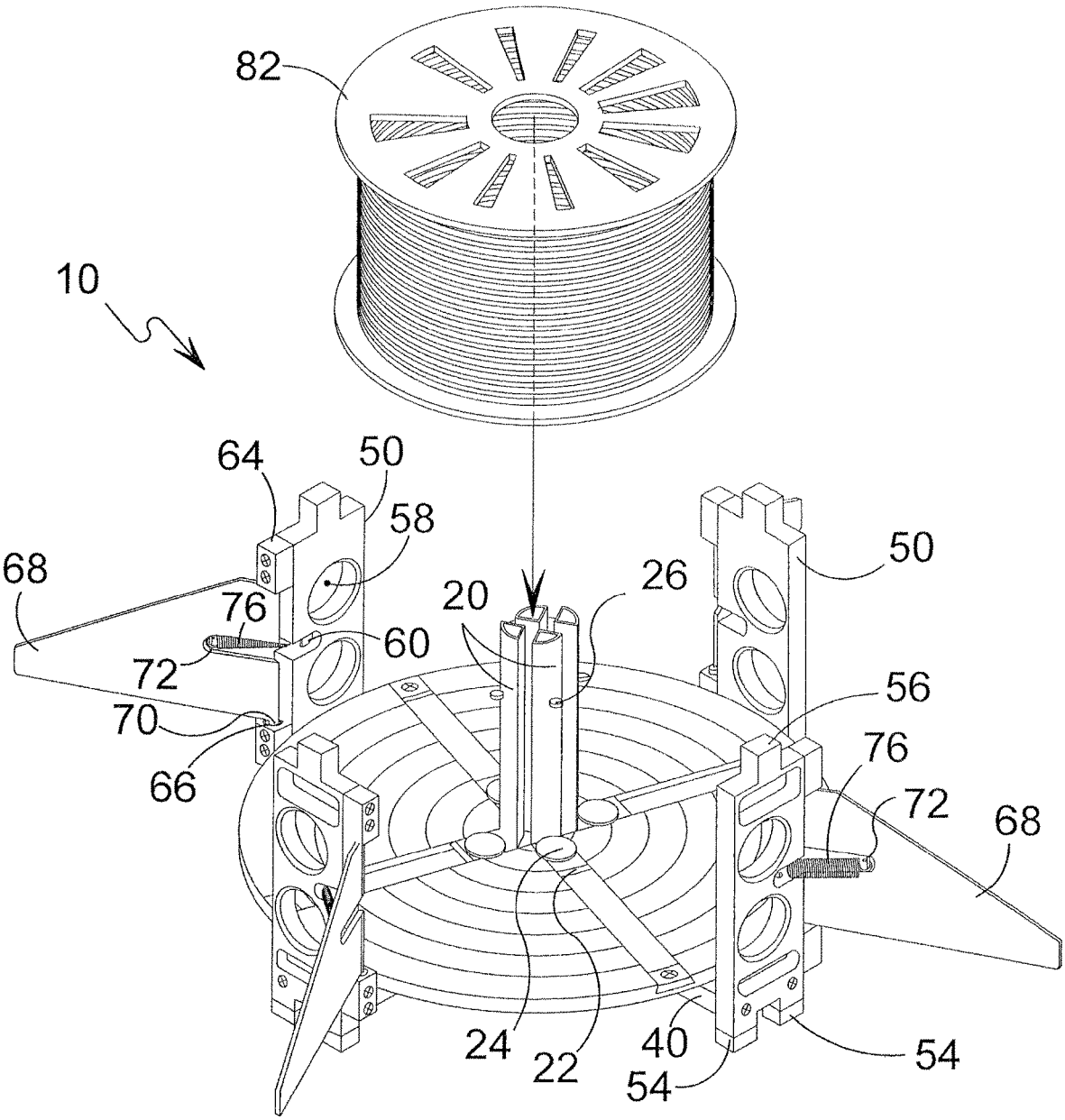
FIG. 8 is a perspective view of the adjustable turntable setting up for receipt of spooled wire.
Figure 9:
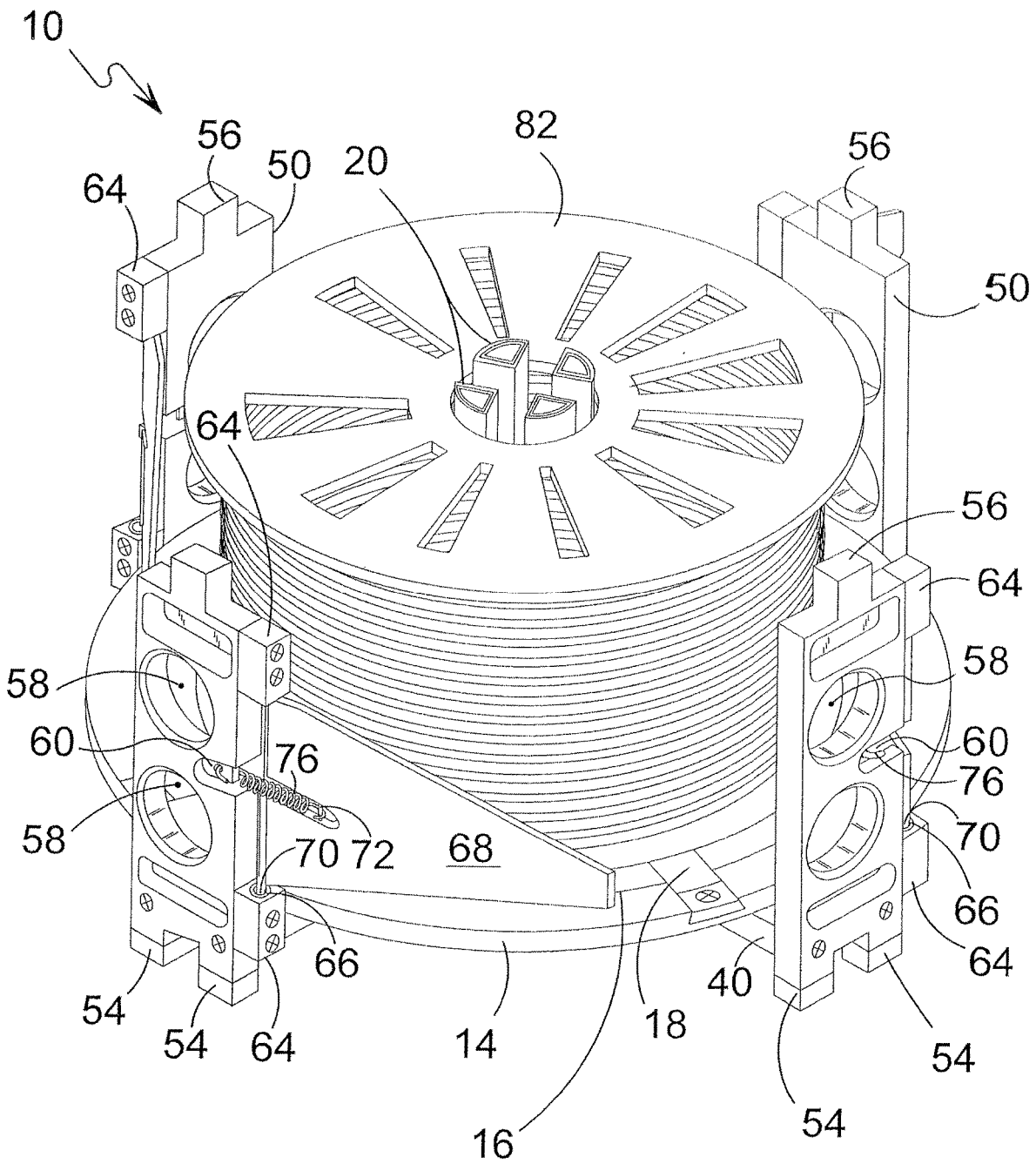
FIG. 9 is a perspective view of the adjustable turntable having received spooled wire.

Referring to FIGS. 7, 8 and 9 illustrations of use of the organizer 10 for spooled wire. As aforementioned, the turnable organizer can be used either with coiled wire or spooled wire with the main difference being the position of the turnable posts. For spooled wire 82, posts 20 are positioned proximate to the center spool aperture with the frame's stanchion flaps maintaining tension on the exterior wall of the roll of spooled wire. FIG. 8 depicts the turnable posts 20 moved to the approximate inner wall of the spool's center aperture for mounting onto turntable 14 with the spool mounted onto turntable 14 with turnable posts 20 extending through the spool's center aperture. The frame's stanchions 50 includes a plurality of apertures 58 that are operable to serve as wire ingress or egress as the wire moves off of and/or onto the spooled wire with the tensioning flap members 68 moved into engagement with the spool, as shown in FIG. 9.

Figure 10:
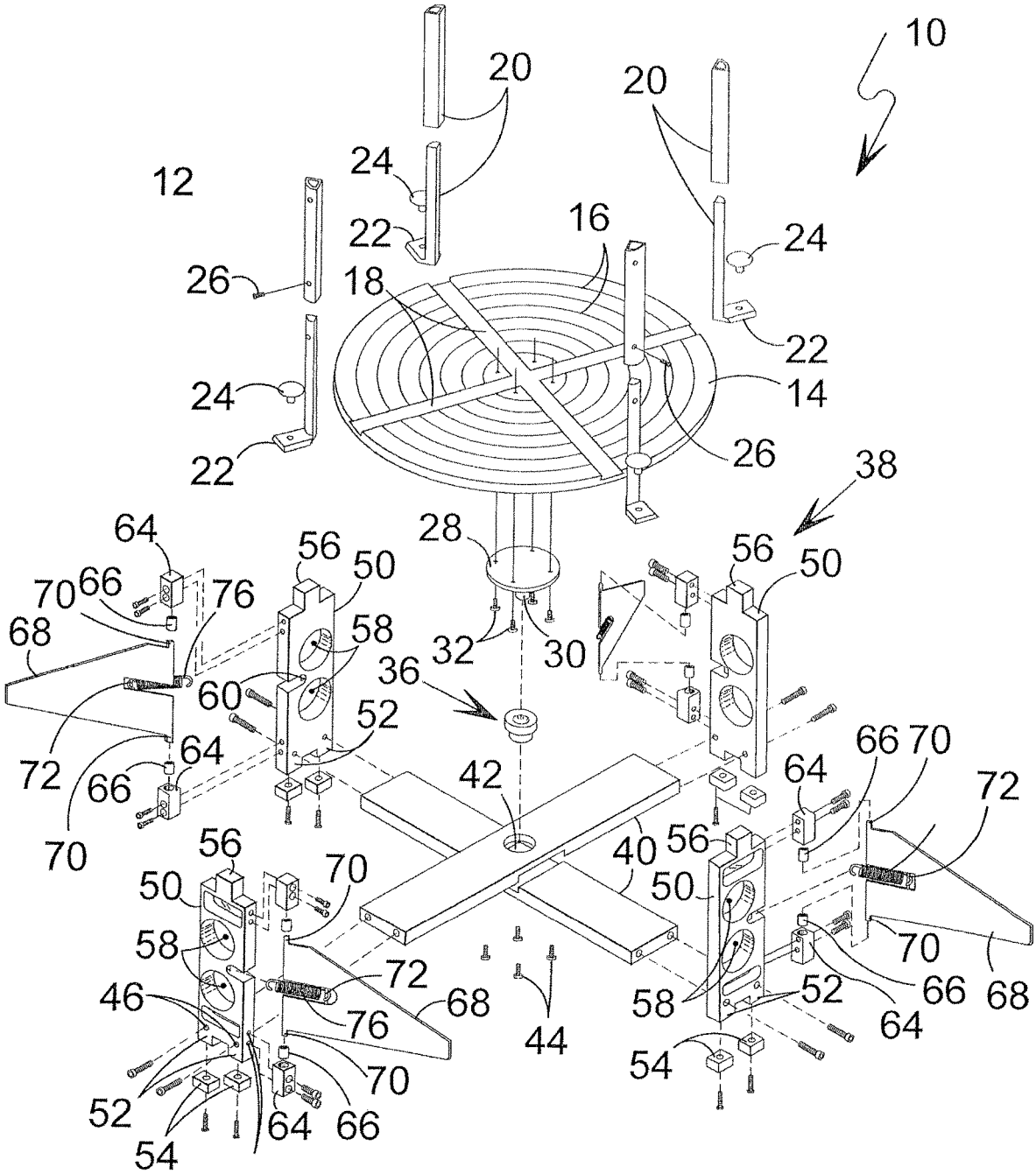
FIG. 10 is an exploded view of the adjustable turntable of the present invention.

FIG. 10 is an exploded view of the organizer of the present invention. Shown is the adjustable turntable 10 comprising turnable 12, hub 36 and base 38. Turnable 12 provides working platform for mounting and feeding rolls of wire or cable and wire on a spool from a turnable and spooling unspooled wire onto the turnable creating a coil of wire. Turnable 12 comprises a turntable 14 having a top surface imprinted with concentric measurements circle 16 and defining shaped radial channels 18 configured to receive telescopic posts 20 each having a post slide portion 22 correspondingly shaped to slide in a respective channel 18. Latching a post 20 within a channel 18 is provided by latch 24 located on post slide portion 22 (aka a post base portion) and latching telescopic post 20 is provided by pin 26. The bottom surface of turntable 14 includes a flange 28 fixedly attached by fasteners 32 with the flange having a depending post 30 that is seated in hub 36 allowing freewheeling rotation of turntable 14.

Base 38 includes the stationary portion of the adjustable turntable 10 comprising a pair of support members 40 each having a longitudinal and linear configuration (and which may also be referred to as longitudinal members) fixedly attached (i.e. "conjoined") to one another in a transverse or criss-cross arrangement by fasteners 44 (such as screws) with the conjoined support members 40 defining a bore 42 configured for receiving a hub 36, the hub 36 enabling the turntable 14 to rotate. To be clear, the turntable 14 may be coupled to and rest upon the hub 36 of the base 38 and thereby have rotational movement.

Fastened to the distal ends of longitudinal members 40 are uprights 50 (which may also be referred to herein as stanchions 50) used to establish an outside coil boundary, each stanchion 50 defining a plurality of feed apertures 58 and serving as support for flaps 68 and seat 60 for attachment of a tensioning member such as a spring 72. Flap supports 64 are attached to an upright side wall spaced away top and bottom with each providing a receptacle for inserting bushing 66 receiving a respective top and bottom flap nub 70 so that flaps 68 are pivotable. With the attachment of a tensioning member, such as spring 76, to flap tension seat 72 and upright tension seat 60 allows the flaps to exert a force upon the outer boundary of a coil of wire/cable or upon a spool of wire/cable.

Each upright 50 is designed with complementary top and bottom shapes operable to provide stackability. More particularly, an upright 50 includes a bottom end having a central channel forming left side and right side leg segments 52 and having subjacent frictional pads 54 with the top end having a middle leg 56 correspondingly sized as the bottom channel and left and right notches. The notches are also similarly sized as the padded left and right bottom legs making the bottom end of one upright 50 mateable with the top end of another upright, i.e. stackable. It should be noted that each base 38 in a stack of adjustable turntables is a stationary component with each of turnable 12 working independently from the other turnables in the stack. As aforementioned, the organizer of the present invention 10 is designed to accept rolls of wire or cable and wire on a spool onto the organizer where the wire feeds out of and/or or into the organizer without bird nesting and by virtue of the frictional feet, such as rubber, prevents the organizer from sliding along a floor surface.

Figure 11:
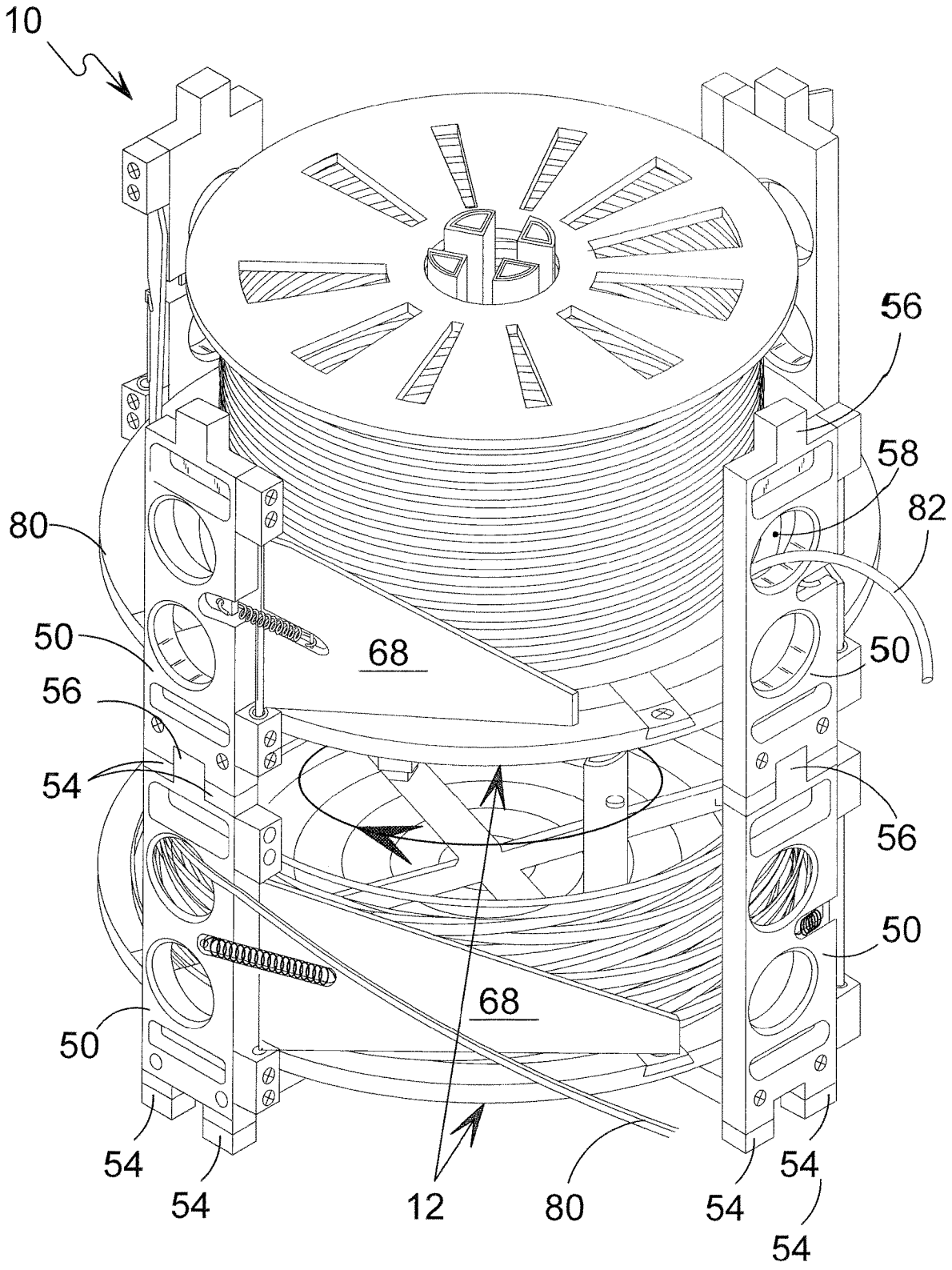
FIG. 11 is a perspective view of stacked adjustable turntables according to the present invention.

Referring to FIG. 11, shown is a pair of stacked adjustable turntables. The organizer is designed to be stacked by virtue of uprights 50 having complementary top and bottom ends. Upright 50 bottom end has a central channel forming left side and right side leg segments 52 provided with frictional pads 54 producing the device's frictional component to prevent slipping on a floor surface. The top end of upright 50 has leg 56 correspondingly sized to the bottom end central channel with left and right notches correspondingly sized to receive the padded left and right bottom legs.

It should be noted that each base 38 in a stack of adjustable turntables 10 is a stationary component with each of turnable 12 working independently from the other turnables in the stack. As aforementioned, the organizer of the present invention 10 is designed to accept rolls of wire or cable and wire on a spool onto the organizer where the wire feeds out of and/or into the organizer without bird nesting and by virtue of the frictional feet 54, such as rubber, prevents the adjustable turntable for coils of wire or cable and wire or cable on a spools 10 from sliding along a floor surface.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed as new and desired to be protected by Letters Patent is set forth in the following claims:

1. An adjustable turntable for receiving a coiled wire or a spool about which a wire or cable is wound, the adjustable turntable, comprising:

a turnable that includes a turntable having a top surface that includes a plurality of measurement circles arranged concentrically and that defines a pair of radial channels, said turnable including a plurality of posts that are length adjustable and positioned in said pair of radial channels, respectively, and configured to receive the spool;

wherein each post includes a post slide portion correspondingly shaped to slide in a respective radial channel and a bottom surface;

a base having a pair of support members each having a longitudinal configuration fixedly attached to one another in a transverse arrangement so as to form conjoined members, said conjoined members defining a bore;

a hub complementary to and received in said bore and operable to receive a flange depending from said turntable for providing freewheeling rotation of said turntable.

2. The adjustable turntable of claim 1, wherein said each post includes a latch for securing said each post at a desired position along a respective radial channel.

3. The adjustable turntable of claim 2, wherein said each post includes an outer post portion and an inner post portion slidably movable in and out of said outer post portion, each of said inner and outer portions defining apertures that, when aligned and secured together with a pin inserted into said apertures, respectively, are length adjustable.

4. The adjustable turntable of claim 1, further comprising a plurality of stanchions mounted to distal ends of said support members and extending upwardly, wherein each stanchion defines at least one feed aperture configured to allow ingress or egress of the wire or cable therethrough.

5. The adjustable turntable of claim 4, wherein a respective stanchion includes:

a bottom end defining a central channel forming a left side bottom leg segment and a right side bottom leg segment, said respective stanchion including a pair of frictional pads coupled to said left side and right side bottom leg segments, respectively; and a top end having a leg that is shaped complementary to the central channel and defining left and right notches configured to receive said pair of frictional pads, of said left and right bottom leg segments, respectively, so that said bottom end of one stanchion is capable of removably mating with said top end of another stanchion in a stackable arrangement.

6. The adjustable turntable of claim 5, further comprising:

a plurality of flaps, a respective flap having a proximal edge pivotally coupled to a side wall of a respective stanchion;

a tensioning member extending between said respective flap and said respective stanchion, said respective flap being urged inwardly by operation of said tensioning member to bear against the coiled wire or the spool and a biased configuration urged outwardly by the coiled wire or the spool.

7. The adjustable turntable of claim 4, further comprising:

a plurality of flaps, a respective flap having a proximal edge pivotally coupled to a side wall of a respective stanchion;

a tensioning member extending between said respective flap and said respective stanchion, said respective flap being urged inwardly by operation of said tensioning member to bear against the coiled wire or the spool and a biased configuration urged outwardly by the coiled wire or the spool.

8. The adjustable turntable of claim 7, wherein said tensioning member is a spring having one end secured to said respective flap and another end secured to an associated stanchion so that said respective flap has a normally inward tensioned force.

9. An adjustable turntable for receiving a coiled wire or a spool about which a wire or cable is wound, the adjustable turntable, comprising:

a turnable that includes a turntable having a top surface that includes a plurality of measurement circles arranged concentrically and that defines a pair of radial channels, said pair of radial channels crossing one another in a perpendicular pattern and each radial channel having a linear configuration and planar surface;

wherein said turntable includes a plurality of posts that are length adjustable and positioned on said planar surfaces of said pair of radial channels, respectively, said plurality of posts extending upwardly and being configured to receive the coiled wire or spool;

wherein each post includes a post slide portion having a bottom surface shaped to slide in a respective radial channel;

wherein said each post includes a latch for securing said each post at a desired position along a respective radial channel;

a base having a pair of support members each having a longitudinal configuration fixedly attached to one another in a transverse arrangement so as to form conjoined members, said conjoined members defining a bore; and a hub complementary to and received in said bore and operable to receive a post depending from said turntable for providing freewheeling rotation of said turntable.

10. The adjustable turntable of claim 9, wherein said each post includes an outer post portion and an inner post portion slidably movable in and out of said outer post portion, each of said inner and outer portions defining apertures that, when aligned and secured together with a pin inserted into said apertures, respectively, are length adjustable.

11. The adjustable turntable of claim 9, further comprising a plurality of stanchions mounted to distal ends of said support members and extending upwardly, wherein each stanchion defines at least one feed aperture configured to allow ingress or egress of the wire or cable therethrough.

12. The adjustable turntable of claim 11, wherein a respective stanchion includes:

a bottom end defining a central channel forming a left side bottom leg segment and a right side bottom leg segment, said respective stanchion including a pair of frictional pads coupled to said left side and right side bottom leg segments, respectively; and a top end having a leg that is shaped complementary to the central channel and defining left and right notches configured to receive said pair of frictional pads, of said left and right bottom leg segments, respectively, so that said bottom end of one stanchion is capable of removably mating with said top end of another stanchion in a stackable arrangement.

13. The adjustable turntable of claim 12, further comprising:

a plurality of flaps, a respective flap having a proximal edge pivotally coupled to a side wall of a respective stanchion;

a tensioning member extending between said respective flap and said respective stanchion, said respective flap being urged inwardly by operation of said tensioning member to bear against the coiled wire or the spool and a biased configuration urged outwardly by the coiled wire or the spool.

14. The adjustable turntable of claim 11, further comprising:

a plurality of flaps, a respective flap having a proximal edge pivotally coupled to a side wall of a respective stanchion;

a tensioning member extending between said respective flap and said respective stanchion, said respective flap being urged inwardly by operation of said tensioning member to bear against the coiled wire or the spool and a biased configuration urged outwardly by the coiled wire or the spool.

15. The adjustable turntable of claim 14, wherein said tensioning member is a spring having one end secured to said respective flap and another end secured to an associated stanchion so that said respective flap has a normally inward tensioned force.

16. The adjustable turnable apparatus as in claim 11, wherein each post includes a quarter round shape so that the posts, when slidably moved adjacent on another along said pair of radial channels converge into a substantially round spindle operable to receive a center aperture of the spool.

17. An adjustable turntable for receiving a coiled wire or a spool about which a wire or cable is wound, the adjustable turntable, comprising:

a turnable that includes a turntable having a top surface that includes a plurality of measurement circles arranged concentrically and that defines a pair of radial channels, said pair of radial channels crossing one another in a perpendicular pattern and each radial channel having a linear configuration and planar surface;

wherein said turntable includes a plurality of posts that are length adjustable and positioned on said planar surfaces of said pair of radial channels, respectively, said plurality of posts extending upwardly and being configured to receive the coiled wire or spool;

wherein each post includes a post slide portion having a bottom surface shaped to slide in a respective radial channel;

wherein said each post includes a latch for securing said each post at a desired position along a respective radial channel;

a base including a support member having a longitudinal configuration having opposed ends, said support member defining a bore about midway between opposed ends; and a hub complementary to and received in said bore and operable to receive a mounting flange depending from said turntable for providing freewheeling rotation of said turntable.

18. The adjustable turntable of claim 17 wherein said each post includes an outer post portion and an inner post portion slidably movable in and out of said outer post portion, each of said inner and outer portions defining apertures that, when aligned and secured together with a pin inserted into said apertures, respectively, are length adjustable.

19. The adjustable turntable of claim 17, further comprising a plurality of stanchions mounted to said support member and extending upwardly, wherein each stanchion defines at least one feed aperture configured to allow ingress or egress of the wire or cable therethrough;

wherein a respective stanchion includes:

a bottom end defining a central channel forming a left side bottom leg segment and a right side bottom leg segment, said respective stanchion including a pair of frictional pads coupled to said left side and right side bottom leg segments, respectively; and a top end having a leg that is shaped complementary to the central channel and defining left and right notches configured to receive said pair of frictional pads, of said left and right bottom leg segments, respectively, so that said bottom end of one stanchion is capable of removably mating with said top end of another stanchion in a stackable arrangement.

20. The adjustable turntable of claim 19, further comprising:

a plurality of flaps, a respective flap having a proximal edge pivotally coupled to a side wall of a respective stanchion;

a tensioning member extending between said respective flap and said respective stanchion, said respective flap being urged inwardly by operation of said tensioning member to bear against the coiled wire or the spool and a biased configuration urged outwardly by the coiled wire or the spool.

* * * * *